US007717731B2

(12) United States Patent
Liao

(10) Patent No.: US 7,717,731 B2
(45) Date of Patent: May 18, 2010

(54) ELECTRICAL CONNECTOR WITH RETAINING SEATS FOR SECURING A LOAD LEVER

(75) Inventor: Chi-Nan Liao, Tu-cheng (TW)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 12/322,116

(22) Filed: Jan. 28, 2009

(65) Prior Publication Data

US 2009/0191745 A1 Jul. 30, 2009

(30) Foreign Application Priority Data

Jan. 28, 2008 (TW) ..... 97201808 U

(51) Int. Cl.
*H01R 13/62* (2006.01)

(52) U.S. Cl. ..... 439/331; 439/73

(58) Field of Classification Search ..... 439/331, 439/70–73, 342, 876
See application file for complete search history.

(56) References Cited

U.S. PATENT DOCUMENTS

| | | | | |
|---|---|---|---|---|
| 6,722,909 | B1 * | 4/2004 | McHugh et al. | 439/331 |
| 6,974,345 | B2 * | 12/2005 | Yang et al. | 439/331 |
| 7,234,955 | B1 | 6/2007 | Ho | |
| 7,278,860 | B2 * | 10/2007 | Ma | 439/73 |
| 2008/0124955 | A1 | 5/2008 | Szu | |

* cited by examiner

*Primary Examiner*—Javaid Nasri
(74) *Attorney, Agent, or Firm*—Andrew C. Cheng; Wei Te Chung; Ming Chieh Chang

(57) ABSTRACT

An electrical connector mounted on a printed circuit board 8 for receiving an IC package includes a socket (2) with a plurality of contacts (3) received therein, a load plate (4) supported by a supporting member (5) and capable of rotating toward or away from the socket (2), a pair of retaining seats (6) separated from each other and spaced from the socket (2), and a load lever (7) secured by the retaining seats (6) and engaging the load plate (4) to fasten the load plate (4) in a closed position.

15 Claims, 5 Drawing Sheets

ELECTRICAL CONNECTOR WITH RETAINING SEATS FOR SECURING A LOAD LEVER

FIELD OF THE INVENTION

The present invention relates to an electrical connector, and more particularly to an electrical connector which is mounted on a printed circuit board (PCB) for receiving an IC package, and which has a pair of retaining seats for securing a load lever.

DESCRIPTION OF PRIOR ART

Central Processing Unit (CPU) and other electrical package, generally referred to as IC package, commonly works via an electrical connector mounted on a printed circuit board, which includes at least a socket with a number of contacts for electrical connection with the IC package and securing means for fastening the IC package.

U.S. Pat. No. 7,278,860 issued to Hao-Yun Ma on Oct. 9, 2007 discloses such an electrical connector, which is soldered on a printed circuit board to receive an IC package. Referring to FIG. 1 and FIG. 4 of this patent, the electrical connector includes an insulative housing with a number of contacts received therein, a metallic stiffener located around the housing, a load plate for pressing an IC package that seated on the housing, and a load lever for fastening the load plate. What is disadvantageous in U.S. Pat. No. 7,278,860 is the metallic stiffener occupies a large periphery area around the housing, therefore it is not helpful to save space on the printed circuit board. Further, the electrical connector employs a stiffener which needs a large amount of metal material, and is also not economic.

Thus, there is a need to provide a new electrical connector that overcomes the above-mentioned problems.

SUMMARY OF THE INVENTION

It is therefore the object of the present invention to provide an electrical connector capable of saving space and helpful for cost down.

In order to achieve the object set forth, an electrical connector made in accordance with the present invention is mounted on a printed circuit board and includes a socket with a plurality of contacts received therein, a load plate supported by a supporting member and capable of rotating toward or away from the socket, a pair of retaining seats separated from each other and spaced from the socket, and a load lever secured on the retaining seats and engaging the load plate to fasten the load plate in a closed position.

BRIEF DESCRIPTION OF THE DRAWINGS

Other objects, advantages and novel features of the present invention will become more apparent from the following detailed description when taken in conjunction with the accompanying drawings, in which.

DETAILED DESCRIPTION OF PREFERRED EMBODIMENT

Figure 1:
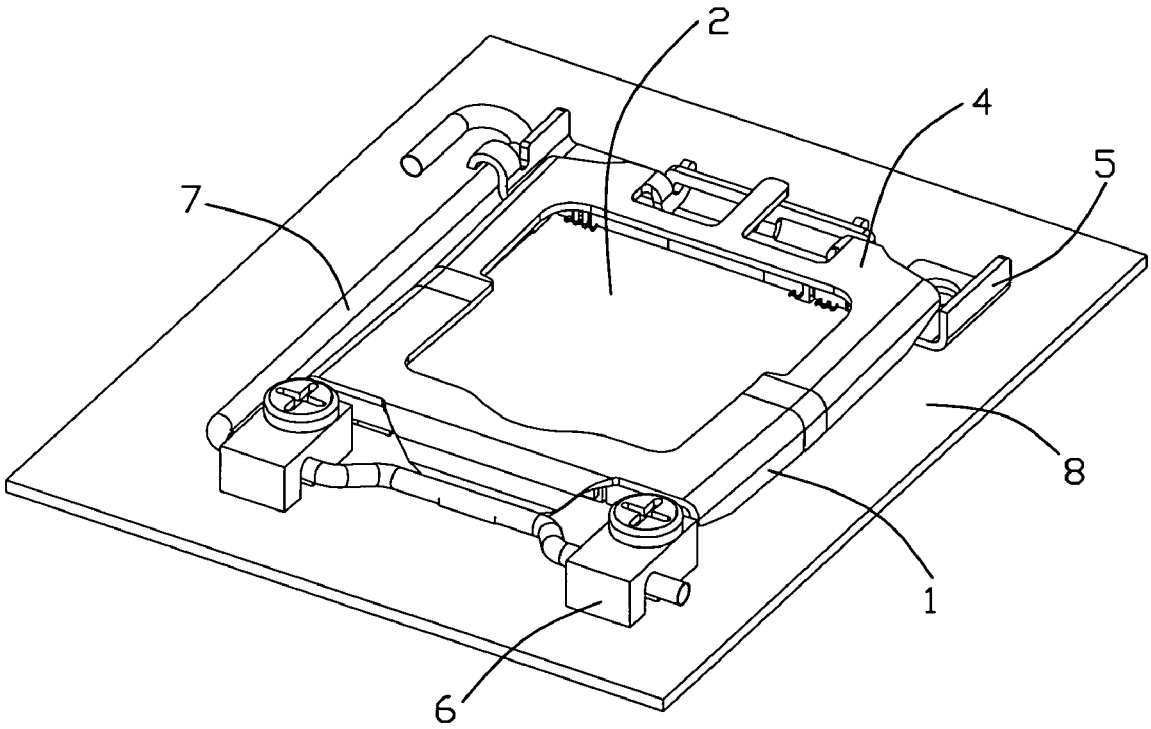
FIG. 1 is an assembled, perspective view of an electrical connector in accordance with a preferred embodiment of the present invention, in which a load plate is in a closed position.
Figure 2:
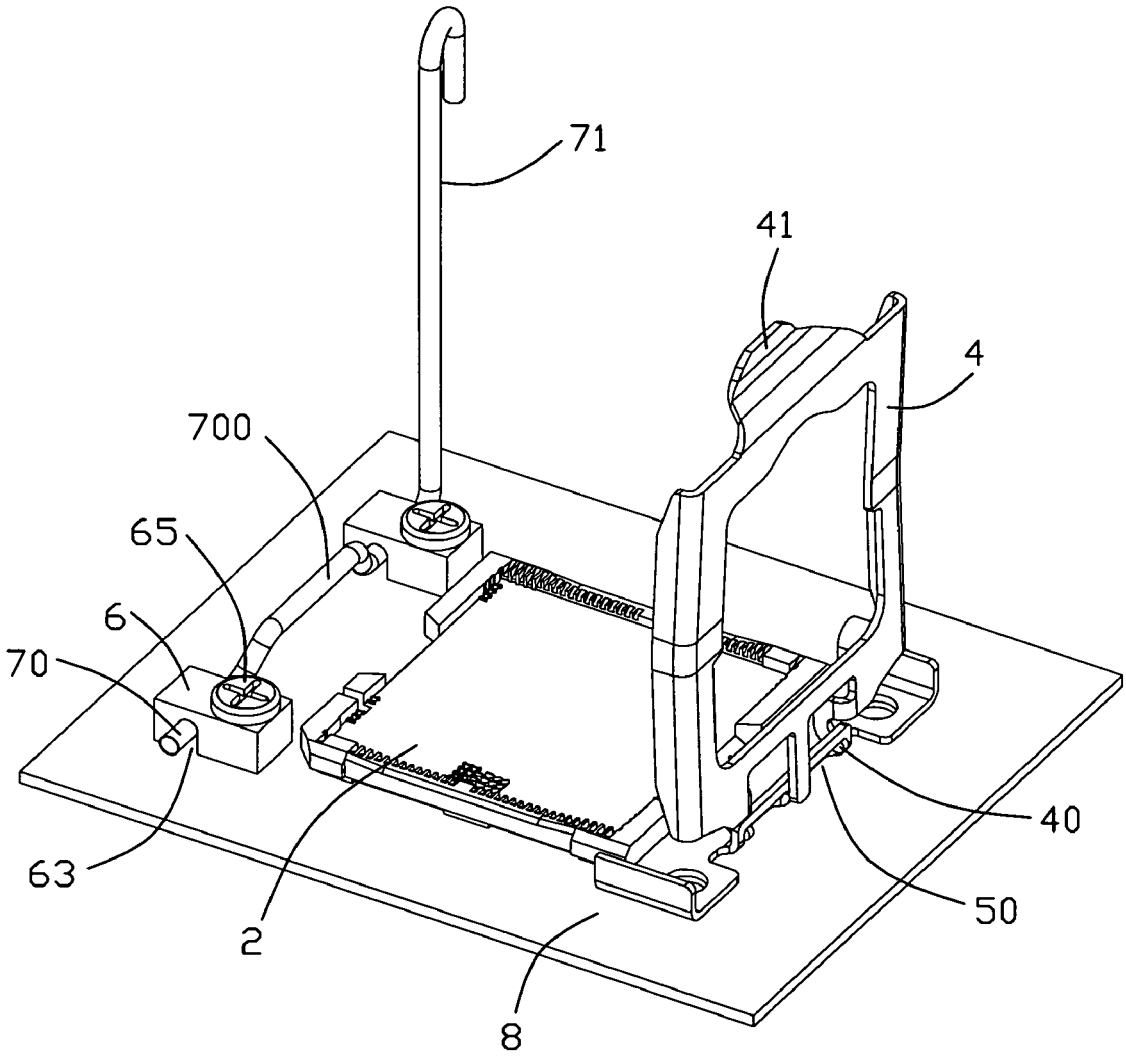
FIG. 2 is an assembled, perspective view of the electrical connector, in which the load plate is in an open position.
Figure 3:
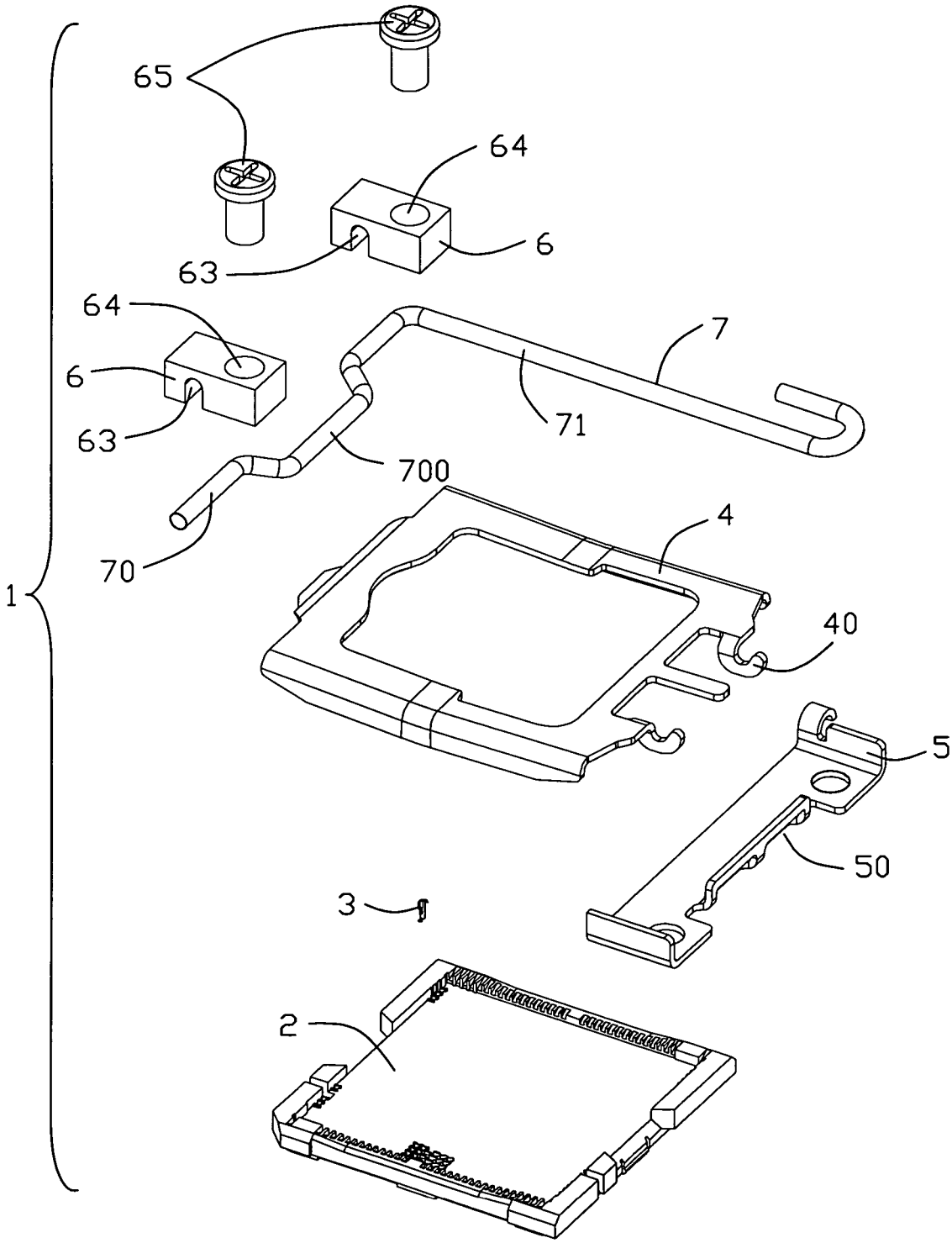
FIG. 3 is an exploded, perspective view of the electrical connector.

Referring to FIGS. 1-3, an electrical connector 1 in accordance with a preferred embodiment of the present invention is generally mounted to a printed circuit board 8 to receive an IC package (not shown). The electrical connector 1 includes a socket 2 with a plurality of contacts 3 therein. The IC package is seated to the socket 2 to make electrical connection with the contacts 3. A load plate 4 is connected and supported by a supporting member 5 and rotates toward the socket 2 to a closed position to fasten the IC package, or rotates away form the socket 2 to an open position to release the IC package. A load lever 7 is provided to engage with the load plate 4 to fasten the load plate 4 in a closed position.

The supporting member 5 made of metal materials are shaped to an elongated pattern and is located at one end of the socket 2. A pair of connecting holes 50 are defined on the supporting member 5 for respectively engaging hooks 40 formed on one end of the load plate 4 to enable the load plate 4 to rotate around the supporting member 5 and rotate relative to the socket 2. The other end of the load plate 4 has a tongue portion 41 for engaging with the load lever 7. The supporting member 5 is able to be positioned on the printed circuit board 8 via multiple means, such as screws (not shown), or by soldering method.

A pair of independent retaining seats 6 are located at the other end of the socket 2 and opposite to the supporting member 5. The two retaining seats 6 are separated from each other and have same configuration. Also, the retaining seats 6 are separated and spaced form the supporting member 5. The load lever 7 is secured on the retaining seats 6.

Figure 4:
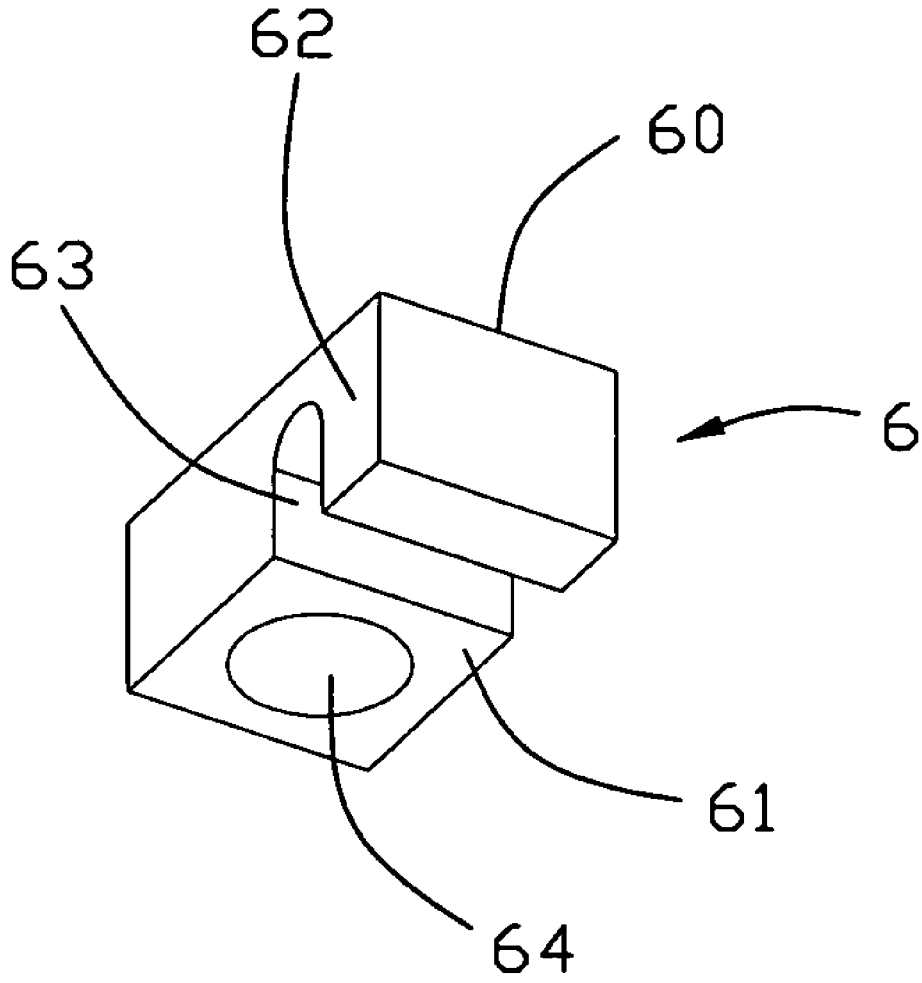
FIG. 4 is a perspective view of a retaining seat in accordance with the preferred embodiment of the present invention.

Particularly referring to FIG. 4, which shows a perspective view of the retaining seat 6 in accordance with the preferred embodiment of the present invention. The retaining seats 6 are separated and spaced a distance from the socket 2, and such a configuration is designed for efficiently simplifying the manufacturing of the socket 2 and the retaining seats 6. The retaining seat 6 in this preferred embodiment is molded of plastic with a substantial cubic shape, and includes a top surface 60, a bottom surface 61 engaging the printed circuit board 8 and two opposite side surfaces 62. A containing hole 63 extends through the bottom surface 61 and the two side surfaces 62. The containing hole 63 cooperates with the printed circuit board 8 to form a closed through hole (not labeled). In addition, the retaining seat 6 has a securing hole 64 formed beside the containing hole 63 to engage with a screw 65 to mount the retaining seat 6 onto the printed circuit board 8.

The load lever 7 includes two pivoting portions 70 and an operating portion 71 perpendicular to the pivoting portions 70. The pivoting portions 70 are secured in the containing holes 63 of the retaining seats 6. A pressing portion 700 engaging the tongue portion 41 of load plate 4 is protruding from the pivoting portions 70 and located between the two retaining seats 6.

Figure 5:
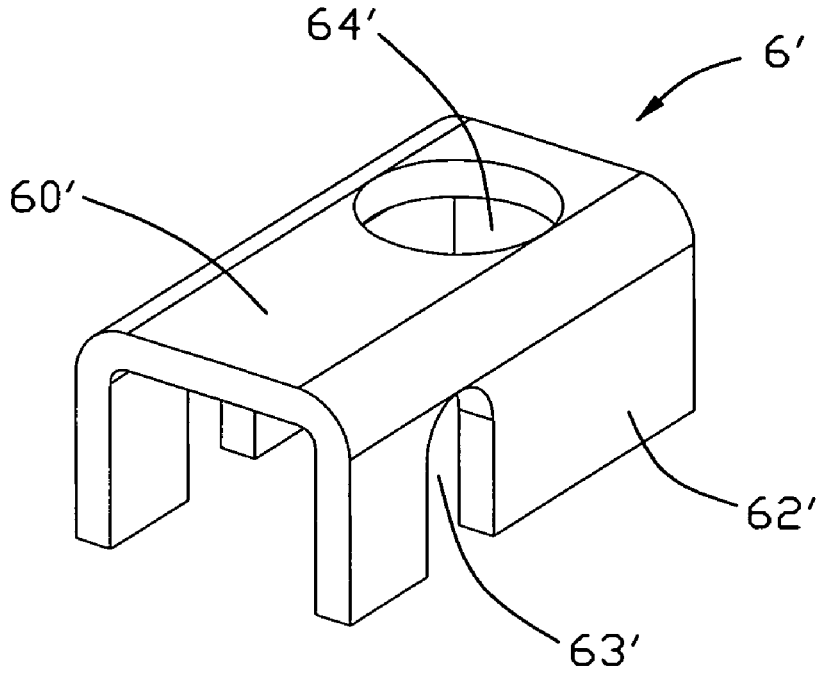
FIG. 5 is a perspective view of a retaining seat in accordance with a second embodiment of the present invention.

FIG. 5 illustrates another retaining seat 6' in accordance with a second embodiment of the present invention. The retaining seat 6' is punched from a metal plate and then bended to such a configuration. The retaining seat 6' has a top portion 60', a pair of side portions 62' extending downward from two edges of the top portion 60'. A pair of containing holes 63' are respectively formed on the side portions 62'. Further on the top portion 60', a securing hole 64' is formed to engage with a screw (not shown) so as to mount the retaining seat 6' onto the printed circuit board 8. The containing hole 63' cooperates with the printed circuit board 8 to form a closed through hole (not labeled) to receive the pivoting portion 70 of the load lever 7.

Figure 6:
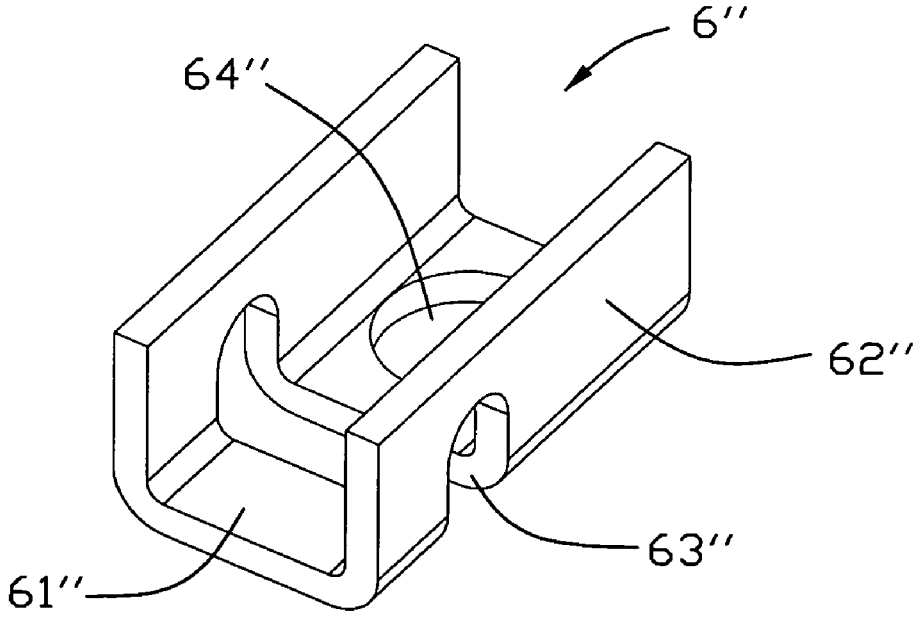
FIG. 6 is a perspective view of a retaining seat in accordance with a third embodiment of the present invention.

FIG. 6 illustrates a third retaining seat 6" in accordance with a third embodiment of the present invention. The retaining seat 6" has a substantial reverse configuration in contrast to the retaining seat 6' in the second embodiment, and includes a bottom portion 61" supported by the printed circuit board 8, a pair of side portions 62" extending upward from two edges of the bottom portion 61". A pair of containing holes 63" are respectively formed on the side portions 62" and communicate with each other by extending across the bottom portion 61" to facilitate assembling the load lever 7. Further on the bottom portion 61", a securing hole 64" is formed to engage with a screw (not shown) so as to mount the retaining seat 6" onto the printed circuit board 8. The containing holes 63" cooperate with the printed circuit board 8 to form a closed through hole (not labeled) to receive the pivoting portion 70 of the load lever 7.

It should be noted that besides the above described embodiments, the load plate 4 also has other modes, for example, directly connected to the socket by a assistant hardware without such a supporting member employed in above embodiments.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector mounted on a printed circuit board comprising:

a socket with a plurality of contacts received therein;

a load plate supported by a supporting member and capable of rotating toward or away from the socket;

a pair of retaining seats separated from each other and spaced from the socket without engagement with the socket; and a load lever secured by the retaining seats and engaging with the load plate to fasten the load plate in a closed position.

2. The electrical connector as claimed in claim 1, wherein the retaining seat has a containing hole for receiving the load lever.

3. The electrical connector as claimed in claim 2, wherein the containing bole cooperates with a printed circuit board on which the electrical connector is mounted, to form a closed through hole.

4. The electrical connector as claimed in claim 3, wherein the retaining seat has a top surface, a bottom surface engaging the printed circuit board and two opposite side surfaces, the containing hole extending through the bottom surface and the two side surfaces.

5. The electrical connector as claimed in claim 3, wherein the retaining seat has a top portion, a pair of side portions extending downward from two edges of the top portion, the containing holes being formed on the side portions.

6. The electrical connector as claimed in claim 3, wherein the retaining seat has a bottom portion supported by the printed circuit board, a pair of side portions extending upward from two edges of the bottom portion, the containing holes being formed on the side portions and communicating with each other to facilitate assembling the load lever.

7. The electrical connector as claimed in claim 1, further comprising a screw for securing the retaining seat to the printed circuit board.

8. The electrical connector as claimed in claim 1, wherein the load lever has pivoting portions secured in the containing hole, and a pressing portion protruding from the pivoting portions and located between the two retaining seats for engaging the load plate.

9. The electrical connector as claimed in claim 1, wherein the supporting member is located at one end of the socket opposite to the retaining seats to connect the load plate, such that the load plate rotates around the supporting member.

10. The electrical connector as claimed in claim 9, wherein the supporting member is separated and spaced from the retaining seats.

11. The electrical connector as claimed in claim 1, wherein said supporting member is discrete from the socket.

12. An electrical connector assembly comprising:

a printed circuit board;

an insulative housing mounted upon the printed circuit board and defining opposite lengthwise first and second ends thereof;

a plurality of contacts disposed in the housing;

a load plate pivotally disposed upon the housing with a first pivot by the first end of the housing;

a load lever pivotally disposed relative to the housing with a second pivot by the second end of the housing; the second pivot defining a pressing section downward pressing against a free end of the load plate and a pair of pivoting portions by two sides of the pressing section; wherein said pair of pivoting portions are respectively engaged by a pair of retaining seats which are independently discrete and spaced from each other and respectively mounted to the printed circuit board, the retaining seats being independent from the housing without engagement therebetween.

13. The electrical connector assembly as claimed in claim 12, wherein each of said retaining seats includes a retaining hole having a closed top end thereof and facing communicatively downwardly toward the printed circuit board so as to cooperate with the printed circuit board to form a closed cavity thereof for retaining the pivoting portion therein.

14. The electrical connector assembly as claimed in claim 12, wherein said pressing section and said pair of pivoting portions are arranged in a crank manner so as to prevent a relative movement of said load lever along the second pivot with regard to the retaining seats.

15. The electrical connector assembly as claimed in claim 12, wherein said load plate is mounted to the printed circuit board via a supporting member which is discrete from the housing.

* * * * *